US007540124B2

(12) United States Patent
Anderson

(10) Patent No.: US 7,540,124 B2
(45) Date of Patent: Jun. 2, 2009

(54) APPARATUS AND METHOD FOR STRETCH WRAPPING A PLURALITY OF TUBES

(75) Inventor: Sherman Dean Anderson, Pala, CA (US)

(73) Assignee: Western Tube & Conduit Corporation, Long Beach, CA (US)

( * ) Notice: Subject to any disclaimer, the term of this patent is extended or adjusted under 35 U.S.C. 154(b) by 161 days.

(21) Appl. No.: 11/637,992

(22) Filed: Dec. 13, 2006

(65) Prior Publication Data

US 2008/0141626 A1 Jun. 19, 2008

(51) Int. Cl.
*B65B 11/56* (2006.01)
*B65B 27/10* (2006.01)

(52) U.S. Cl. ..... 53/399; 53/441; 53/465; 53/556; 53/587; 53/211

(58) Field of Classification Search ..... 53/399, 53/587, 502, 441, 465, 556, 210, 211, 213, 53/215, 216; *B65B 11/56, 27/10*
See application file for complete search history.

(56) References Cited

U.S. PATENT DOCUMENTS

| | | | | | |
|---|---|---|---|---|---|
| 2,844,928 | A | * | 7/1958 | Clem | 53/587 |
| 2,872,767 | A | * | 2/1959 | Clem | 53/587 |
| 3,175,693 | A | | 3/1965 | Steel | |
| 3,863,425 | A | | 2/1975 | Edwards et al. | |
| 3,864,191 | A | | 2/1975 | Tovarys | |
| 3,871,288 | A | | 3/1975 | White | |
| 3,928,939 | A | | 12/1975 | Edwards et al. | |
| 4,173,108 | A | | 11/1979 | Eglinton et al. | |
| 4,362,001 | A | | 12/1982 | Cockerham, Jr. et al. | |
| 4,553,372 | A | | 11/1985 | Back | |
| 4,565,051 | A | | 1/1986 | Back | |
| 4,723,395 | A | * | 2/1988 | Koutonen | 53/587 |
| 4,882,892 | A | * | 11/1989 | Pienta | 53/587 |
| 4,912,911 | A | | 4/1990 | Down | |
| 5,042,225 | A | | 8/1991 | Drury et al. | |
| 5,483,785 | A | | 1/1996 | DiCarlo | |
| 5,487,255 | A | | 1/1996 | Soderberg | |
| 5,577,366 | A | | 11/1996 | Higgins | |
| 5,628,167 | A | | 5/1997 | Huson et al. | |
| 5,641,263 | A | | 6/1997 | Ogrinc et al. | |
| 5,715,655 | A | | 2/1998 | Soderberg | |
| 5,727,359 | A | | 3/1998 | Rampp | |

(Continued)

FOREIGN PATENT DOCUMENTS

DE 19721332 A1 * 12/1997

(Continued)

*Primary Examiner*—Stephen F Gerrity
(74) *Attorney, Agent, or Firm*—Foley & Lardner LLP

(57) ABSTRACT

An apparatus and method for wrapping a plurality of tubes which includes a plurality of supporting stations, each of which includes a pair of stanchions upon which pulleys are positioned. An endless belt is threaded along the pulleys and one of the pulleys is driven by a drive motor to move the endless belt to rotate a bundle of tubes positioned on the belt. A roll of stretch wrapping plastic material such as polyethylene is disposed upon a trolley movable along a rail. The polyethylene plastic film engages the exterior of the bundle of tubes and as the bundle rotates, the film is moved from the roll to encompass and wrap the bundle of tubes.

22 Claims, 3 Drawing Sheets

U.S. PATENT DOCUMENTS 5,870,883 A * 2/1999 Soderberg ..... 53/399
5,966,904 A 10/1999 Peters
6,588,329 B1 7/2003 Paris

FOREIGN PATENT DOCUMENTS

EP 197007 A1 * 10/1986
EP 621182 A1 * 10/1994
EP 733550 A1 * 9/1996
FR 2693165 A1 * 1/1994
JP 02098508 A * 4/1990
JP 02282021 A * 11/1990
JP 5170211 A 7/1993
JP 5336830 A 12/1993
JP 11029118 A * 2/1999

* cited by examiner

APPARATUS AND METHOD FOR STRETCH WRAPPING A PLURALITY OF TUBES

BACKGROUND OF THE INVENTION

1. Field of the Invention

The present invention relates generally to wrapping of articles with a stretchable plastic material and more specifically to a method and apparatus for wrapping a plurality of metal tubes with a stretchable plastic material.

2. Description of the Prior Art

It is known to wrap various articles of various shapes with stretchable plastic film such as polyethylene or the like. Generally, in the prior art the wrapping of such items has been accomplished in one of two ways. The first is to pass the object, particularly an elongated object to be wrapped through a machine which is constructed in the form essentially of a cage. On the outer portion of the cage there is positioned a roll of stretchable plastic wrapping material and the cage is caused to rotate around the object to be wrapped. As the cage rotates, the film passes around the object to cause the object to be wrapped. Either the cage is caused to move along the length of the elongated object or alternatively, the cage remains essentially longitudinally stationary while it rotates and the elongated object to be wrapped is moved through the center of the cage thus distributing the wrapping material along the length of the elongated object.

The other type of film wrapping or stretch wrapping apparatus is referred to as pallet wrapping. In this type of structure a pallet is positioned in the center of the wrapping machine and the pallet with the object to be wrapped is then rotated causing the film to be pulled from a roll or magazine thereof causing the wrapping material to surround the object. In either instance, such wrapping machines are cumbersome, take up a lot of space, are not portable and are difficult to operate.

There is thus a need for an apparatus which is essentially portable, takes up a minimum of space and is easy to use to wrap elongated objects such as a plurality or bundle of metallic tubes.

SUMMARY OF THE INVENTION

The present invention is an apparatus for wrapping a plurality of tubes which includes first and second tube supporting stations, each of which includes first and second spaced apart stanchions. Each of the stanchions includes means for engaging, supporting, and rotating the plurality of tubes. There is provided a source of wrapping material. Means for supporting the wrapping material is provided adjacent the tube supporting stations and for moving the wrapping material along the plurality of tubes to cause the wrapping material to encircle the tubes as the tubes are rotated.

The present invention also is directed to a method for wrapping a plurality of tubes which includes the steps of supporting a plurality of tubes for rotation, rotating said tubes, providing a source of stretchable wrapping material, engaging the wrapping material with the exterior surface of the rotating plurality of tubes and moving the wrapping material along the plurality of tubes while said plurality of tubes are being rotated to cause said wrapping material to encircle said plurality of tubes.

BRIEF DESCRIPTION OF THE DRAWINGS

The present invention is further described in the detailed description which follows in reference to the noted drawings by way of a non-limiting example of the preferred embodiment of the present invention and wherein.

DETAILED DESCRIPTION

An apparatus for stretch wrapping elongated objects particularly a bundle of tubes constructed in accordance with the present invention includes a plurality, in the preferred embodiment three, flexible belts which are supported between spaced apart stanchions to provide a tube supporting station. The three tube supporting stations are longitudinally displaced one from the other to provide support along the entire length of the bundle of tubes that are to be wrapped with stretch wrapping material. The belts are adjustable in their vertical positioning by moving the stanchions closer together or further apart to accommodate bundles of tubes having different diametrical dimensions. If the diametrical dimension is larger, the stanchions are moved further away from each other thus causing the vertical position or droop of the belt to move upwardly. If the bundle of tubes is of a smaller diameter, then the stanchions are moved closer together causing the droop or the vertical position of the belt to drop further down. The belts are driven by motors attached to pulleys, one at each of the support stations, to cause the bundle of tubes supported on the flexible belt to rotate. As the tubes rotate, a web of flexible plastic wrapping material, such as polyethylene is pulled from a roll thereof supported upon a trolley positioned on a rail that extends along the length of the apparatus. The web is thus caused to encompass the bundle of tubes thereby encasing the same in the flexible wrapping material. The trolley is moved along the rail at a rate such as to cause the wrapping material to be applied along the entire longitudinal length of the bundle of tubes. The web of wrapping material may overlap slightly to maintain a continuous wrapping of the bundle of tubes.

The apparatus of the present invention may be readily moved from position to position, is relatively easy to operate and takes up a minimum of space as compared to prior art wrapping machines.

Figure 1:
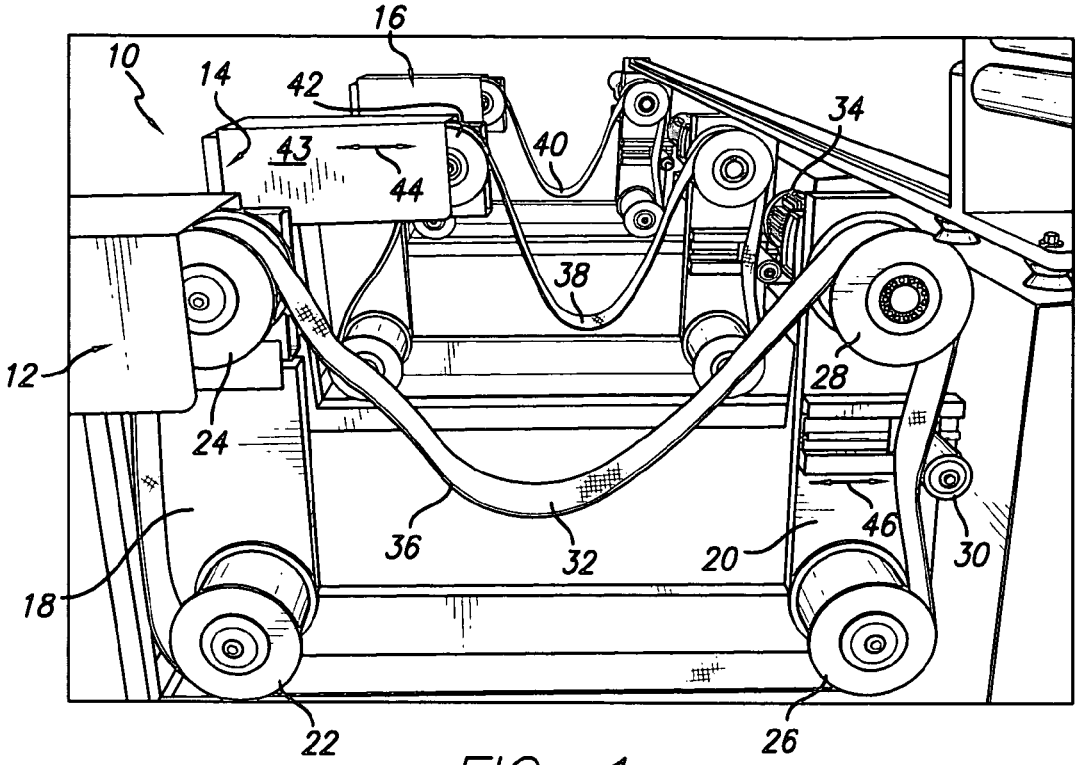
FIG. 1 is a perspective view of a stretch wrapping machine constructed in accordance with the principles of the present invention.

Referring now to the drawings and more particularly to FIG. 1, there is illustrated at 10 an apparatus constructed in accordance with the principles of the present invention for wrapping a plurality of tubes. As is therein shown, the apparatus includes tube supporting stations 12, 14, and 16. Three such tube supporting stations are used in accordance with the preferred embodiment of the present invention, however, depending upon the length of the bundle of tubes to be wrapped more or less than the three tube supporting stations may be utilized. As is illustrated, the tube supporting stations are longitudinally displaced from each other. The tube supporting station 12 includes a first stanchion 18 and a second stanchion 20. The stanchion 18 has rotatably secured thereto first and second pulleys 22 and 24. The second stanchion 20 has rotatably secured thereto third and fourth pulleys 26 and 28. An idler roller 30 is secured to the second stanchion 20. An endless belt 32 is threaded around the pulleys 22-28. The pulley 28 is driven a motor 34 to drive the endless belt 32 in a clockwise direction (as viewed in FIG. 1) so as to impart counter clockwise rotation to a bundle of tubes (not shown in FIG. 1) which would be resting on the belt 32.

Each of the tube supporting stations such as shown at 14 and 16 is constructed in a manner similar to that described with regard to the tube supporting station 12. As can be seen in FIG. 1, the loop in the belts is different with the loop in the belt 32 being very wide, that is the vertical disposition of the bottom 36 of the belt is higher (as viewed in FIG. 1) than is the bottom of the belts at the tube supporting stations 14 and 16 as is illustrated at 38 and 40. It will be understood by those skilled in the art that when a specific bundle of tubes is being wrapped, the bottom of the belts at each supporting station at each of the supporting stations will be adjusted to be at the same vertical height. The illustration in FIG. 1 is merely to illustrate that the position of the belts at each supporting station may be adjusted to accommodate bundles of tubes of differing diametrical dimensions. The adjustment of the belts is accomplished by laterally positioning the pulley as shown at 24 in the station 12. Such lateral positioning is illustrated at the tube supporting station 14 where the pulley 42 has been moved toward the right thus causing the bottom of the belt loop as shown at 38 to be lower than the bottom of the belt loop 36 at the tube supporting station 12. Such movement of the pulley 42 is accomplished by lateral movement of a movable beam 43 as illustrated by the arrow 44. The pulley 42 is supported on the movable beam 43. The position of the idler roller 30 may also be laterally adjusted as shown by the arrow 46. The adjustment of the idler roller 30 may be accomplished to assure that the tension in each of the belts is substantially the same thereby assuring that the vertical disposition of the bottom of the loops 36, 38, and 40 are substantially the same during any wrapping operation.

Figure 2:
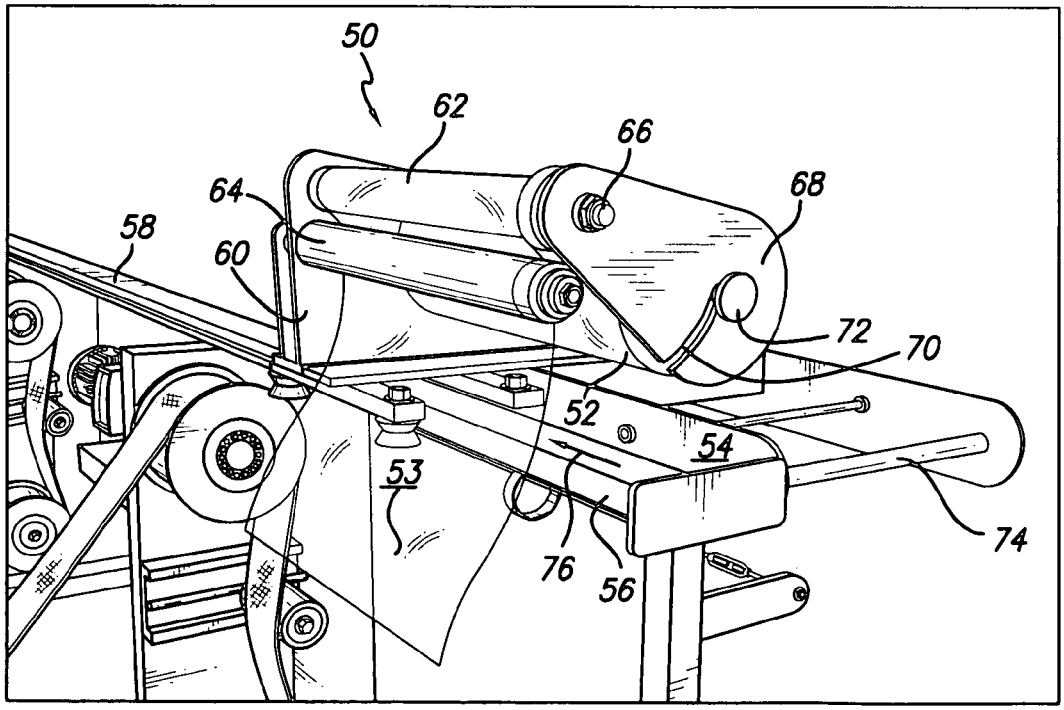
FIG. 2 is a perspective view of the wrapping material being supported adjacent to the wrapping machine.

Referring now more particularly to FIG. 2, there is illustrated at 50 the disposition of a source of wrapping material. As is therein shown, a roll 52 of flexible, stretchable plastic wrapping material such as a polyethylene film 53. The roll 52 of polyethylene film is supported upon a trolley 54. The trolley 54 includes a base 56 which is supported upon a rail 58 to be more fully described below. Affixed to the base 56 is an upstanding flange 60. The flange 60 supports a pair of rollers 62 and 64. Rotatably attached to the end 66 of the roller 62 is an arm 68 which includes a slot 70 which receives one end 72 of a spool upon which the roll 52 of wrapping film is supported. The other end of the spool 72 is fitted within an opening on the flange 60 with the combination of the flange 60 and the arm 68 securely holding the roll 52 of the film in place on the trolley 54. The film 53 is passed over the top of the roller 62 and under the roller 64. As will be explained more fully below as the bundle of tubes rotates the film 53 is pulled from the roll 52 during the wrapping operation.

Means is provided to move the trolley 54 on the rail 58 as the wrapping operation progresses. In accordance with one embodiment of the present invention, a hand bar 74 is provided. The operator once the wrapping operation starts, grips the hand bar 74 and pushes the trolley 54 in the direction of the arrow 76 to cause the film 53 to be evenly wrapped around the bundle of tubes as the bundle is rotated by movement of the belts by the drive motors.

Figure 3:
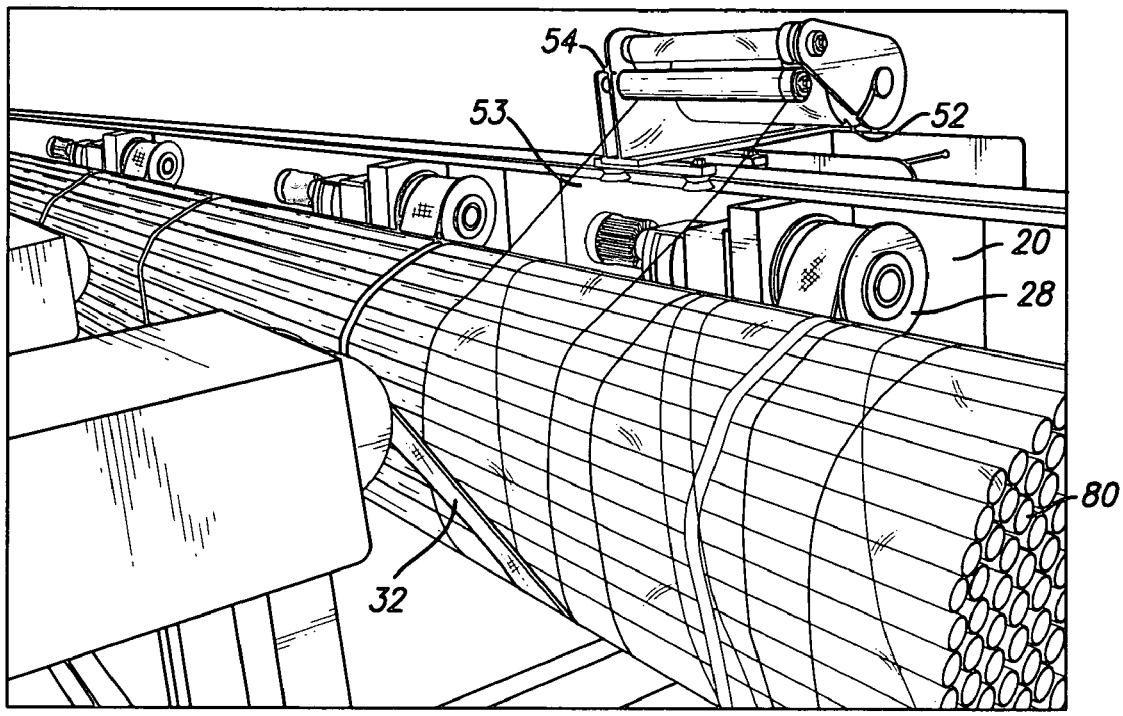
FIG. 3 is a perspective view showing a plurality of tubes being wrapped.
Figure 4:
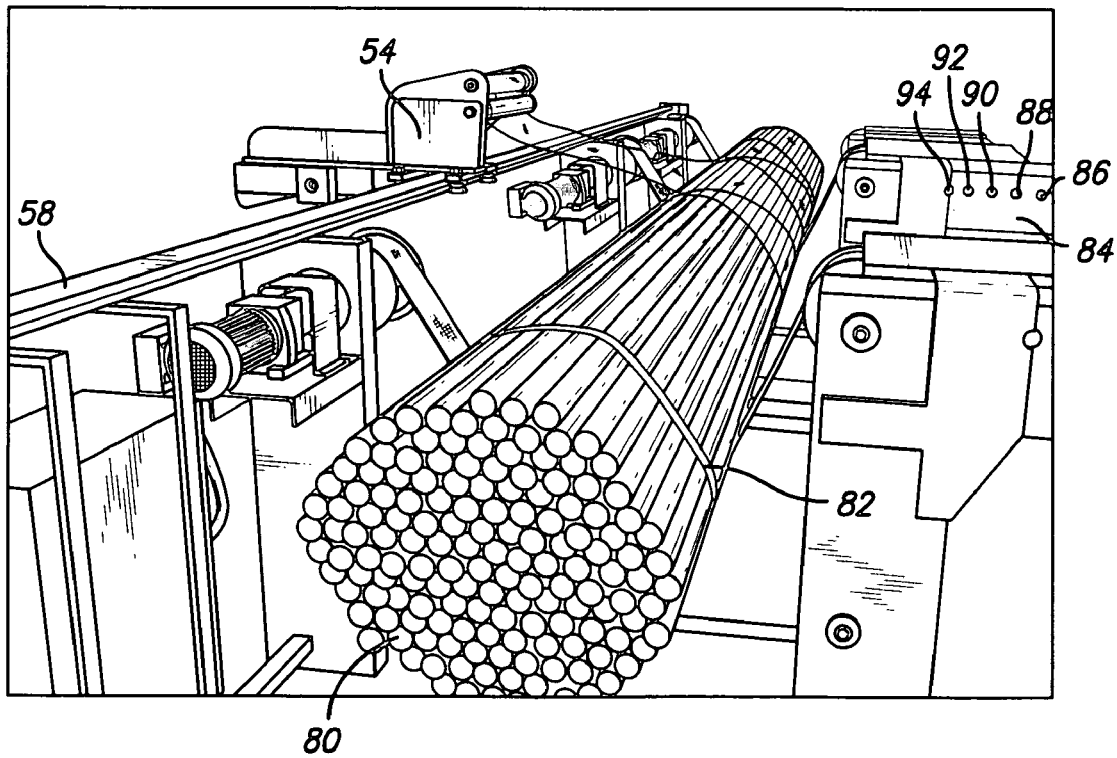
FIG. 4 is a perspective view similar to FIG. 3 but from the opposite end.

By reference now to FIGS. 3 and 4, there is illustrated a bundle 80 of tubes being wrapped with the flexible film 53. As is also shown particularly in FIG. 3, the trolley 54 has been moved toward the left in FIG. 3 from its original end position immediately adjacent the stanchion 20. As illustrated in FIG. 3, the belt 32 passes under the bundle 80 of tubes and over the pulley 28 and moves to cause the bundle 80 of tubes to rotate in a counter clockwise direction (as viewed in FIG. 3) thereby pulling the web of film 53 from the roll 52 thereof to wrap the bundle of tubes 80. It should also be noted that the bundle of tubes 80 is held together by a plurality of bands, one of which is shown at 82. The bands such as shown in 82 are spaced along the bundle 80 of tubes to maintain the integrity of the bundle during wrapping operation. It should also be understood that although the bundle 80 of tubes is shown to be circular in configuration that any geometric form may be utilized, such for example, as placing the bundles of tubes in a square or other polygonal configuration and then securing the same with such bands to maintain the integrity of the geometric configuration. As a result, it will be understood by those skilled in the art that a bundle of tubes or other elongated objects having any geometric configuration may be wrapped with the stretch wrapping material utilizing the apparatus constructed in accordance with the present invention.

The rail 58 upon which the trolley 54 traverses is better seen in FIG. 4. As above indicated, the trolley 54 is moved along the rail as the wrapping operation occurs. As above indicated, an operator will grasp the hand rail 74 and push the trolley 54 along the rail 58 as the wrapping operation occurs. Alternatively, the trolley 54 may include a drive motor which has a gear or frictional engagement with the rail 58 with appropriate control mechanisms to sense the dispensing of the film 53 from the roll 54 thereof and thus move the trolley 54 in a manner and at a speed to provide appropriate wrapping of the bundle of tubes 80 as they are rotated by the belts.

As is better illustrated in FIG. 4, the adjustability of the position of the pulleys is seen. As is therein shown, a movable beam 84 has a plurality of openings as shown at 86 through 94. When it is desired to adjust the looping of the belts as above described in conjunction with FIG. 1, a pin may be removed allowing the beam 54 to be moved in or out depending upon the original position of a pulley and the desirability of adjustment to provide the appropriate position of the bottom of the loop of the belt. Once such is done, the pin or other securing apparatus will then be reinserted in place to maintain the position of the pulley as desired. Obviously, one of the pulleys at each of the supporting stations on the stanchions such as the one disposed at 18 in FIG. 1 will be identically adjusted. Although there is illustrated a plurality of openings in the beam 84 to accomplish the adjustment such may be done by an appropriate drive mechanism at each of the supporting stations which can be activated to move the stanchions supporting the pulleys to the desired position by inputting appropriate command signals.

Figure 5:
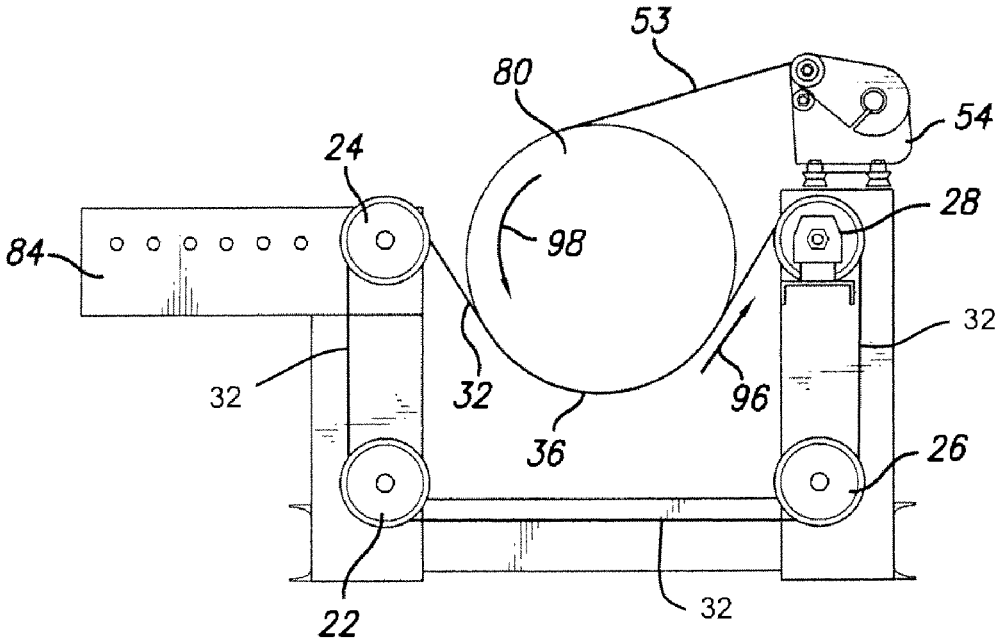
FIG. 5 is a schematic representation of the elements of a supporting station adjusted to receive a large diameter bundle of tubes.

By referring now more particularly to FIG. 5, there is provided a schematic illustration in side view thereof of the apparatus of the present invention. As is illustrated in FIG. 5, the bundle of tubes 80 is relatively large and the endless belt 32 has been positioned so that the bottom 36 of the loop is elevated upwardly to provide a greater open area to receive the bundle of tubes 80. As above described, such has been accomplished through the use of the movable beam 84 to move the pulley to the left as viewed in FIG. 5. The pulley 28 is driven to cause the belt 36 to move in the direction shown by the arrow 96 thereby pulling the wrapping film 53 from the trolley 54 to cause it to encircle and wrap the bundle of tubes 80 by causing the bundle 80 to move in a counter clockwise direction as shown by the arrow 98.

Figure 6:
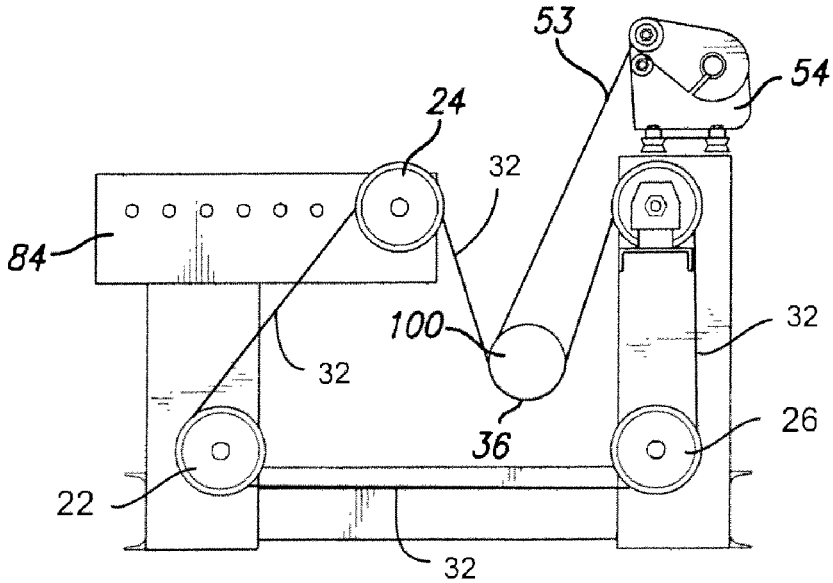
FIG. 6 is a schematic representation similar to FIG. 4 but adjusted to receive a small diameter bundle of tubes to be wrapped.

In FIG. 6, to which reference is hereby made, the pulley 24 has been moved toward the right by movement of the beam 84 as above described to cause the bottom 36 of the belt loop to be lower thereby accommodating a bundle of tubes 100 which has a smaller diametrical dimension than the bundle of tubes 80 shown in FIG. 5. Otherwise, the operation of the wrapping apparatus as shown in FIG. 6 is identical to that as shown in FIG. 5 as above described.

There has thus been disclosed a stretch wrapping apparatus which is easy to operate, takes up a minimum of space, and may be moved from position to position to accommodate the wrapping of a bundle of elongated objects such as tubes, as well as a method of wrapping such tubes.

What is claimed is:

1. An apparatus for wrapping a longitudinally extending bundle of tubes comprising:

at least first and second bundle supporting stations longitudinally spaced apart along said bundle, each of said stations comprising first and second stanchions laterally spaced apart relative to said bundle;

means supported by said first and second stanchions for engaging, supporting and rotating said bundle;

a source of wrapping material;

means for supporting said wrapping material adjacent said bundle supporting stations and for longitudinally moving said wrapping material along said bundle to cause said wrapping material to encircle said bundle as said bundle is rotated and means for adjusting the lateral spacing between the laterally spaced apart stanchions.

2. Apparatus for wrapping a longitudinally extending bundle of tubes as defined in claim 1, wherein said means supported by said first and second stanchions for engaging, supporting and rotating said bundle is an endless belt.

3. Apparatus for wrapping a longitudinally extending bundle of tubes as defined in claim 2, wherein said stanchions each include a plurality of pulleys, said endless belt being supported by said pulleys, and one of said pulleys is driven to cause said belt to move and rotate said bundle.

4. Apparatus for wrapping a longitudinally extending bundle of tubes as defined in claim 3, wherein said means for adjusting the lateral spacing further comprises means for adjusting the vertical position of the belt to accommodate bundles of differing configurations.

5. Apparatus for wrapping a longitudinally extending bundle of tubes as defined in claim 4, wherein said means for the vertical position of the belt comprises a movable beam, at least one of said pulleys being supported on said movable beam.

6. Apparatus for wrapping a longitudinally extending bundle of tubes as defined in claim 1, wherein said wrapping material is a roll of flexible plastic material.

7. Apparatus for wrapping a longitudinally extending bundle of tubes as defined in claim 6, wherein said means for supporting said wrapping material is a rail disposed adjacent said bundle supporting stations and a trolley movably supported on said rail, said trolley receiving said roll of plastic material.

8. Apparatus for wrapping a longitudinally extending bundle of tubes as defined in claim 7, which further includes means for transporting said trolley along said rail as said bundle is rotated.

9. A method of wrapping a longitudinally extending bundle of tubes comprising:

providing a plurality of longitudinally spaced apart endless belts rotatably supported from supports laterally spaced apart relative to said bundle;

supporting said bundle upon said plurality of endless belts;

driving said belts to impart rotational movement to said bundle;

providing a source of flexible wrapping material;

engaging said bundle with said wrapping material, whereby as said bundle is rotated, said wrapping material encircles said bundle;

adjusting the lateral spacing between said laterally spaced apart supports to accommodate bundles of differing configurations.

10. The method as defined in claim 9, which includes the further step of moving said source of wrapping material longitudinally along said bundle as said bundle is rotated.

11. The method as defined in claim 10 further comprising the step of adjusting said plurality of endless belts to receive said bundle.

12. The method as defined in claim 11 wherein said adjusting is accomplished by moving a pulley upon which said endless belt is supported.

13. Apparatus for wrapping a plurality of tubes comprising:

at least first and second tube supporting stations, each of said stations comprising first and second spaced apart stanchions;

means supported by said first and second stanchions for engaging, supporting and rotating said plurality of tubes;

a source of wrapping material;

means for supporting said wrapping material adjacent said tube supporting stations and for moving said wrapping material along said plurality of tubes to cause said wrapping material to encircle said tubes as said tubes are rotated;

wherein one of said stanchions comprises means for adjusting the vertical position of said means supported by said first and second stanchions, to accommodate pluralities of tubes of differing configurations, said means for adjusting remaining in a substantially fixed vertical location as said plurality of tubes is rotated.

14. Apparatus for wrapping a plurality of tubes as defined in claim 13, wherein said supported by said first and second stanchions is an endless belt.

15. Apparatus for wrapping a plurality of tubes as defined in claim 14, wherein said stanchions each include a plurality of pulleys, said endless belt being supported by said pulleys, and one of said pulleys is driven to cause said belt to move and rotate said plurality of tubes.

16. Apparatus for wrapping a plurality of tubes as defined in claim 15, wherein said means for adjusting comprises a moveable beam, at least one of said pulleys being supported on said movable beam.

17. Apparatus for wrapping a plurality of tubes as defined in claim 13, wherein said wrapping material is a roll of flexible plastic material.

18. Apparatus for wrapping a plurality of tubes as defined in claim 17, wherein said means for supporting said wrapping material is a rail disposed adjacent said tube supporting stations and a trolley movably supported on said rail, said trolley receiving said roll of plastic material.

19. Apparatus for wrapping a plurality of tubes as defined in claim 18, which further includes means for transporting said trolley along said rail as said tubes are rotated.

20. The method of wrapping a plurality of tubes comprising:

providing a plurality of endless belts to receive said plurality of tubes;

supporting said tubes upon said plurality of endless belts;

driving said belts to impart rotational movement to said plurality of tubes;

providing a source of flexible wrapping material;

engaging said plurality of tubes with said wrapping material, whereby as said tubes are rotated, said wrapping material encircles said tubes;

vertically adjusting said endless belts to accommodate pluralities of tubes of differing configurations: and refraining from vertically adjusting said endless belts while said tubes are rotated.

21. The method as defined in claim 20, further comprising moving said source of wrapping material along said plurality of tubes as said tubes are rotated.

22. The method as defined in claim 21, further comprising adjusting the endless belts by moving a pulley upon which said endless belt is supported.

* * * * *